US005322088A

United States Patent [19]

Sampers et al.

[11] Patent Number: 5,322,088

[45] Date of Patent: Jun. 21, 1994

[54] SPLIT LOOM HAVING A REMOVABLE LOOM PART INCLUDING DETACHABLE HARNESS HOLDING APPARATUS

[75] Inventors: Dirk Sampers, Oostveleteren; Daniel Beyaert, Loker-Heuvelland; Marc Gruwez, Zwalm, all of Belgium

[73] Assignee: Picanol N.V., Belgium

[21] Appl. No.: 45,191

[22] Filed: Apr. 13, 1993

[30] Foreign Application Priority Data

Apr. 15, 1992 [BE] Belgium ..... 09200342

[51] Int. Cl.[5] ..... D03J 1/00

[52] U.S. Cl. ..... 139/1 R; 139/82; 28/208

[58] Field of Search ..... 28/208, 203.1, 204; 139/1 R, 82

[56] References Cited

U.S. PATENT DOCUMENTS

| | | | |
|---|---|---|---|
| 3,675,686 | 7/1972 | Steiner et al. | 28/208 |
| 4,910,837 | 3/1990 | Fujimoto et al. | 28/208 |
| 4,934,413 | 6/1990 | Yao . | |

FOREIGN PATENT DOCUMENTS

| | | |
|---|---|---|
| 2024483 | 12/1970 | Fed. Rep. of Germany . |
| 3708598 | 1/1987 | Fed. Rep. of Germany . |
| 3828730 | 3/1989 | Fed. Rep. of Germany . |
| 661065 | 6/1987 | Switzerland . |
| 668608 | 1/1989 | Switzerland . |

*Primary Examiner*—Andrew M. Falik
*Attorney, Agent, or Firm*—Bacon & Thomas

[57] ABSTRACT

A split loom includes securing elements which can be affixed to a removable loom part to receive the harnesses before separating the removable loom part from a stationary loom part, thereby retaining the harnesses in predetermined positions until re-assembly of the removable loom part to the stationary loom part.

10 Claims, 5 Drawing Sheets

SPLIT LOOM HAVING A REMOVABLE LOOM PART INCLUDING DETACHABLE HARNESS HOLDING APPARATUS

BACKGROUND OF THE INVENTION

1. Field of the Invention

The invention concerns a weaving loom which includes a stationary loom part containing a harness drive, and a removable loom part containing a warp-beam bearing and holders for harnesses, the holders being detachable from the harness drive and removable along with the removable loom part.

2. Description of Related Art

A weaving loom which includes a stationary loom part containing a harness drive, and a removable loom part containing a warp-beam bearing and holders for harnesses, the holders being detachable from the harness drive and removable along with the removable loom part is disclosed in Swiss patent publication No. CH 668 608 A5. In the machine disclosed in the Swiss publication, the harness guides are components of the removable loom part. The Swiss document does not, however, disclose any means for, following detachment of the harness drive, keeping the harnesses in the harness guides.

SUMMARY OF THE INVENTION

It is an objective of the invention to provide a loom of the type disclosed in the Swiss document, in which however the detachment of the harnesses from the harness drive and their re-connection to the harness drive can be carried out in simple manner.

In one particularly advantageous aspect of the invention, the harnesses are kept at predetermined heights, as a result of which there is load relief between the harnesses and the harness drive. Consequently, it is possible to easily separate the harness drive from the harnesses, and also to easily re-connect the harness drive to the harnesses. Moreover, the harnesses removed together with the removable loom part may be brought to different predetermined heights, so that, where called for, the mounting of tensioning rods is facilitated whenever the tensioning rods are required for automated warp tieing and/or for pulling the tied warps of a new warp beam into the eyes of the heddles.

In another particularly advantageous aspect of the invention, the holders are mounted to harness frames outside the heddle regions. As a result, the heddles need not be displaced within the harness frames as is the case when using a lifting tool for harness sets, for example as disclosed in Swiss patent publication No. CH 661 065 A5. In this embodiment, the holders and the securing means will not hamper automated warp threading into the heddle-eyes.

According to still another particularly advantageous feature of the invention, at least two different securing means are provided, each associated with several harnesses and adjustable to different heights.

DETAILED DESCRIPTION OF THE PREFERRED EMBODIMENTS

Figure 1:
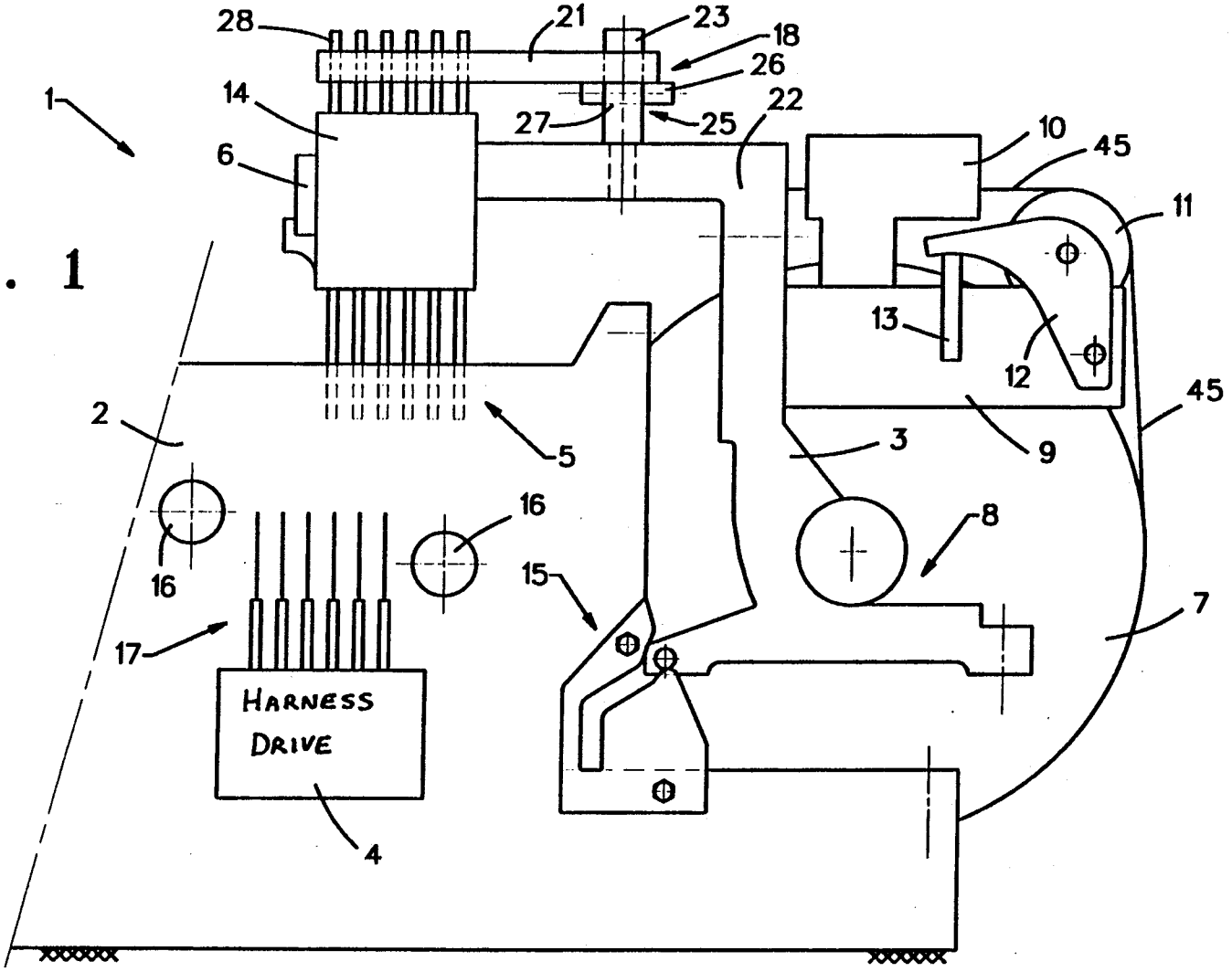
FIG. 1 shows a preferred embodiment of a split loom during assembly of the two loom parts or during removal of the removable loom part.
Figure 2:
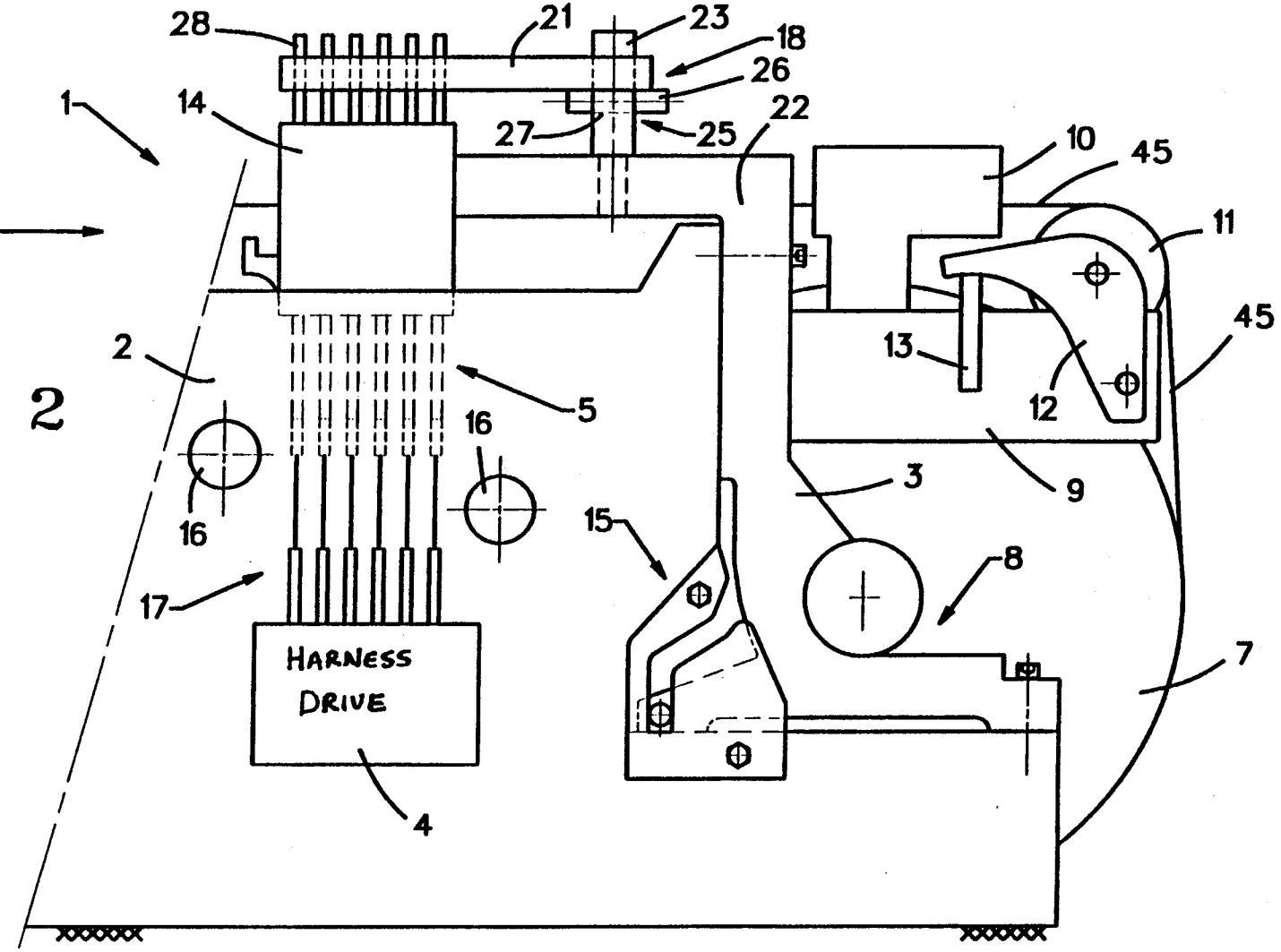
FIG. 2 shows the weaving machine of FIG. 1 in the assembled state.

A weaving loom 1 which has been split into two parts is shown in FIGS. 1 and 2. The two parts consist of a stationary loom part 2 and a removable loom part 3.

The stationary loom part 2 supports a batten drive (not shown), a fabric roll-up system (not shown), a warp-beam drive (not shown) and a schematically indicated harness drive 4, and is made up of two lamellar side parts connected together by crossbars 16.

The removable loom part 3 carries a warp-beam bearing 8 for a warp-beam 7, the harnesses 5, and a reed 6 which is detachable from its drive and which can be deposited in a holder. The removable loom part 3 furthermore includes a warp stop-motion 10 and a back-beam 11 supported by arms 9 affixed in height-adjustable manner on the loom part 3 formed by two lamellar side parts. The back-beam 11 rests on a rocker 12 itself supported on springs 13. The warps 45 are withdrawn from the warp-beam 7 and placed over the back-beam 11 and made to pass through the warp stop-motion 10 as well as through the harnesses 5 and the reed 6.

Guides 15 are present between the lamellar side parts of the stationary loom part 2 and the removable loom part 3 for constraining relative motion of the two parts to a predetermined path during the initial movement of the parts away from each other upon disassembly of the removable part 3 from the stationary part 2 and during the final motion of the parts towards each other upon re-assembly of the removable part 3 and stationary part 2.

The harness guides 14 are mounted on arms 22 of the removable loom part 3. In order to retain the harnesses 5 at predetermined heights relative to the harness drive especially when detaching and also when re-joining the couplings 27, the two smaller side parts of the removable loom part 3 are fitted with securing means 18 which shall be discussed in detail in relation to FIGS. 3 and 4. These securing means 18 are installed before removing the removable part 3 and, following re-assembly of the removable loom part 3 and stationary loom part 2, are then taken off.

Each harness 5 includes a frame made up of lateral frame members 19 and of transverse frame members 20, the frame enclosing the region of the heddles 29 comprising eyes 30. In the embodiment of FIGS. 1 through 4, holders 28 acting as outwardly projecting stops are present at the upper ends of the lateral frame members 19 of the frames of the harnesses 5. These holders 28 cooperate with securing elements 21 to secure the harnesses 4 when they are no longer held by the harness drive 4.

L-shaped securing elements 21 are mounted on the arms 22 of the side parts of the removable loom part 3. A first leg of each of securing elements 21 extends in the direction of advance of the fabric as far as the region of the holders 28 of the harnesses 5. A second leg which is transverse to the first leg of each of securing elements 21, is guided by means of a support 23 which extends through a borehole 24 in the second leg. These supports 23 are inserted or screwed into boreholes of the arms 22 of the side parts of the loom part 3, and include snap-in means 25 for affixing the securing elements 21 to the supports 23 at a predetermined height. The snap-in means used in the illustrated embodiment are cross-boreholes 27 of the supports 23 and pins 26 insertable therein.

Figure 3:
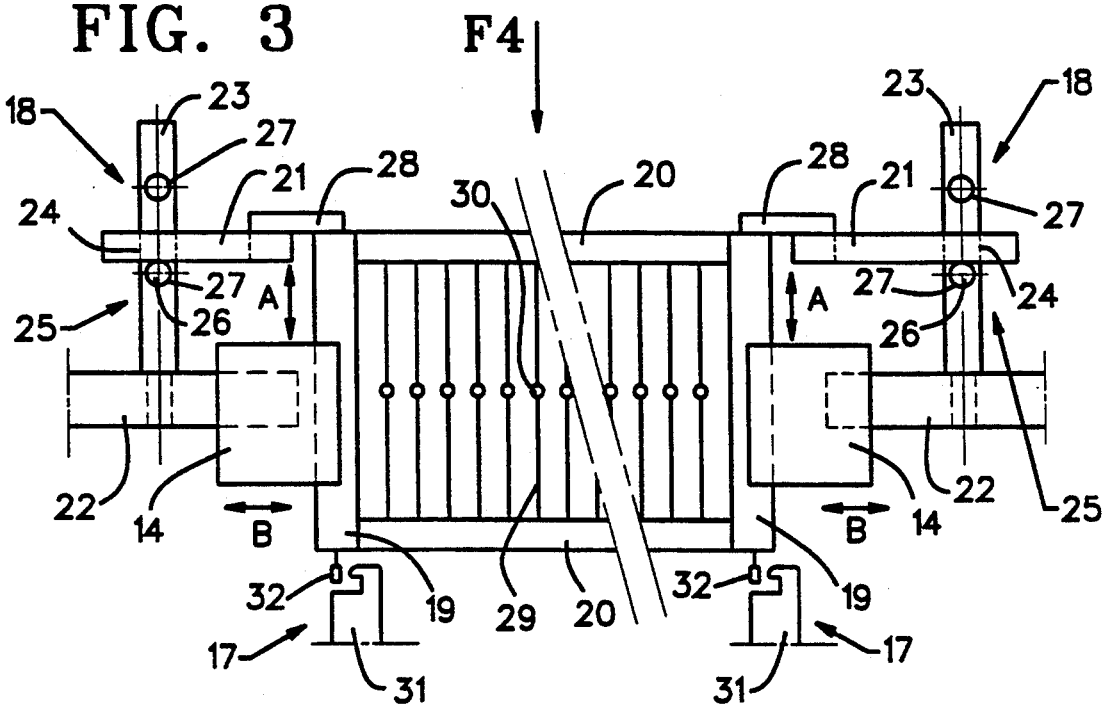
FIG. 3 is a partial view in the direction of arrow F3 of FIG. 2.
Figure 4:
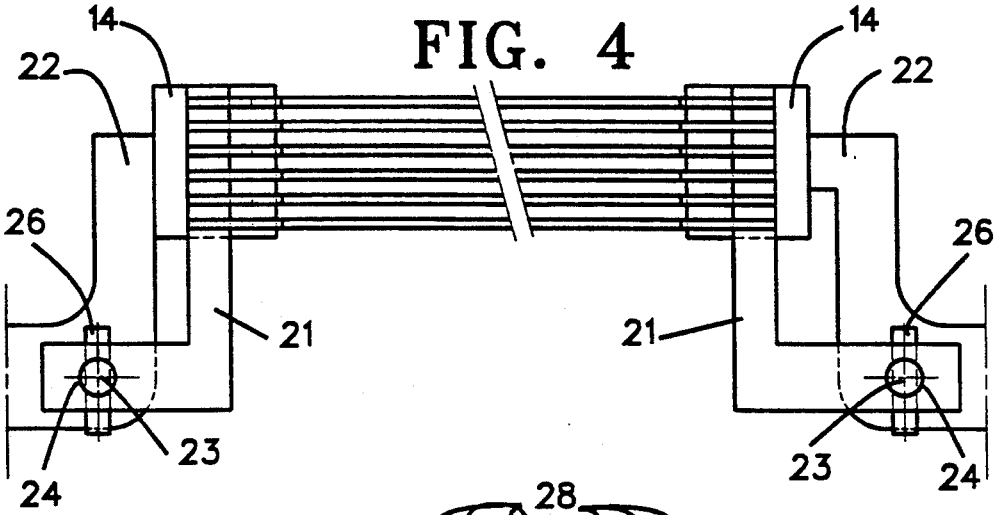
FIG. 4 is a top view in the direction of arrow F4 of FIG. 3.

As shown in FIG. 3, the harness guides 14 are transversely adjustable (arrow direction B) as known from, for example, U.S. Pat. No. 3,888,284. By means of this transverse adjustment, the couplings 17 between the harness drive 4 and the harnesses 5 can be detached and rejoined. The coupling elements 31 of the harness drive and the associated coupling elements 32 of the harnesses are indicated in schematic manner in FIG. 3.

In order to disassemble the removable loom part 3 from the stationary loom part 2, the harnesses 5 are optionally set at approximately the same height by means of the harness drive, after which the harness guides 14 together with the harnesses are displaced sideways (arrow direction B) until the coupling elements 32 are disengaged from the coupling elements 31 but are still resting on the coupling elements 31. Thereupon the securing means 18, including supports 23 and securing elements 21, are mounted on both arms 22 so as to be located underneath the holders 28. Next the securing elements are lifted relative to lateral harness frame members 19 (arrow direction A) until the position shown in FIG. 3 is reached, at which point the securing elements 21 touch the holders 28. Thereafter the pins 26 are inserted into a borehole 27 of the rests 23. Then the removable loom part 3 can be disassembled from the stationary part 2.

After the removable loom part 3 has been re-assembled, the pins 26 are removed. The securing elements 21 are displaced downward along lateral frame members 19 of the harness until the coupling elements 32 rest on the coupling elements 31 of the harness drive 4. Then the securing means 18 are removed. Next, the harness guides 14 together with the harnesses 5 are moved sideways in the direction of arrow B in order to mutually engage the coupling elements 31, 32.

It will be apparent to those skilled in the art based on the above description that the harnesses 5 also can be received when they are not all at precisely the same height. There is no need to set all harnesses 5 at the same height before mounting the securing means. The securing elements 21 need not necessarily touch all holders 28 of the individual harnesses before disassembling the removable loom part 3. However, at the end of the vertical disassembly motion constrained by the guides 15, the securing elements need to touch holders 28.

The embodiment of FIGS. 5 through 8 differs from that of FIGS. 1 through 4 first in that the securing elements 21 are held in a continuously height-adjustable manner by rests 35. In this embodiment, each of the rests includes a screw 34 engaging a thread of the securing elements 21. In a modified embodiment, the continuous adjustment is carried out by a pneumatic cylinder or an electric motor.

Figure 8:
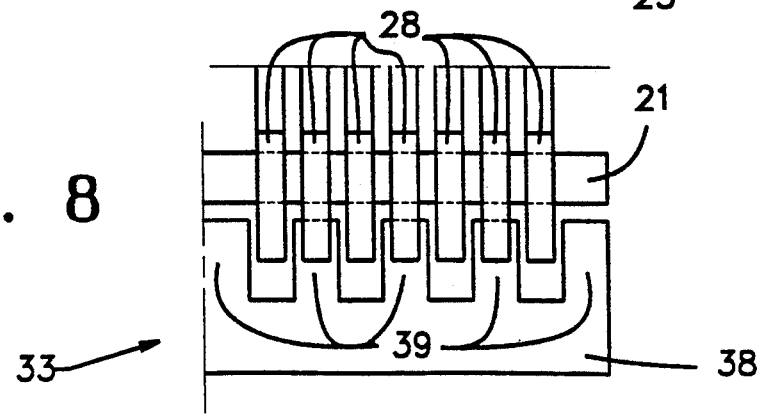
FIG. 8 is a top view in the direction of arrow F8 of the partial view of FIG. 6.
Figures 5, 6, 7:
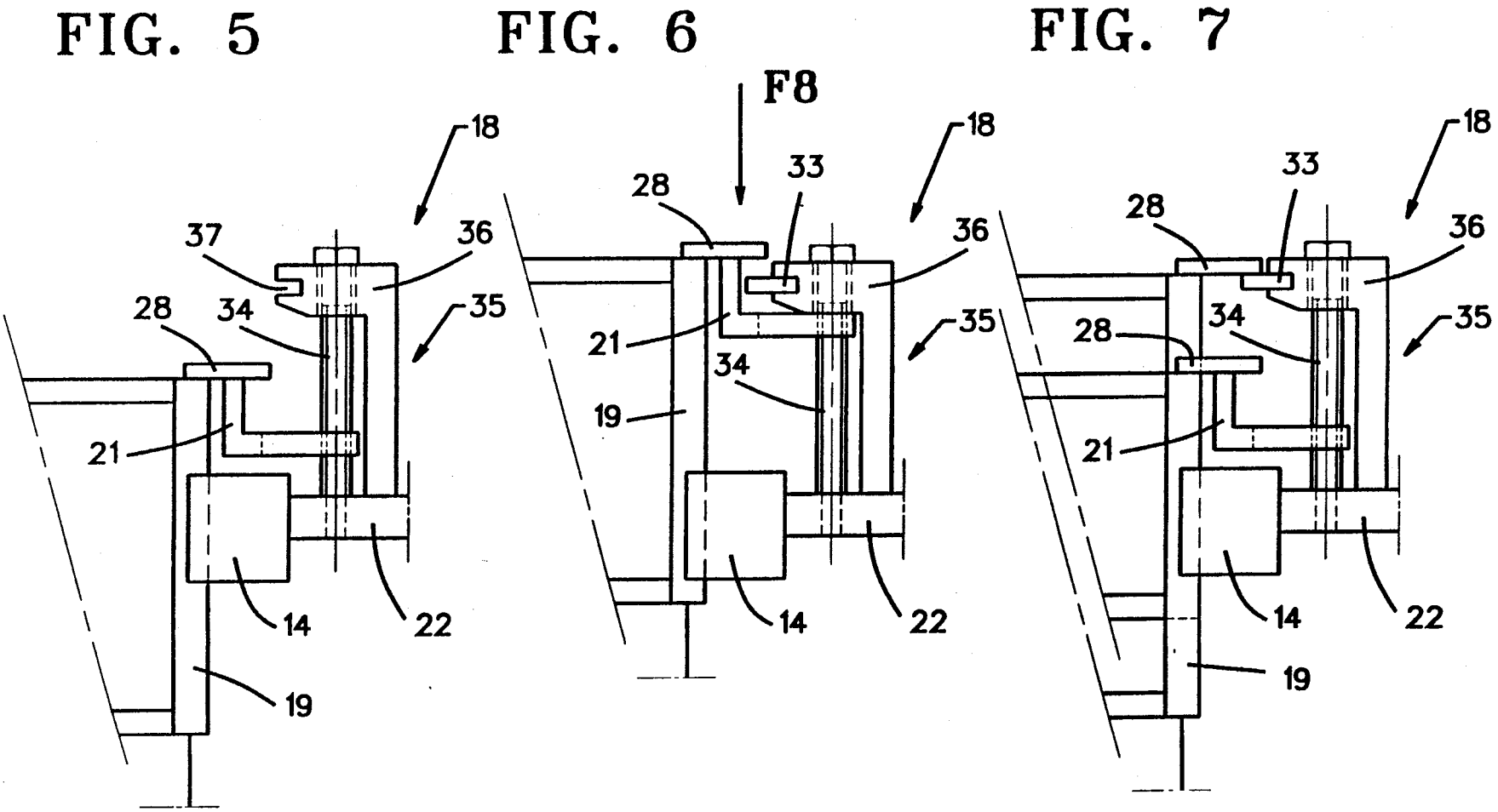
FIGS. 5–7 are views of a segment of the preferred weaving machine with different harness positions.

In the area of their upper ends 36, the rests 35 include a longitudinal groove 37 be entered by a further securing element 33 which, as illustrated in FIG. 8, is in the form of a comb-like strip 38. The strip 38 includes tines 39 illustratively associated with the holders 28 of every second harness 5.

When disassembling the removable loom part 3 according to the embodiment of FIGS. 5 through 8, the securing elements 21 are first mounted and then, after loosening the connections between the harnesses and the harness drive, the securing elements 21 are lifted by means of the screws 34 until they at least touch the securing elements 28 or lift harnesses 5 at the securing elements 28. When in this position, the loom can be disassembled.

In order to affix tensioning rods or the like, different sets of warps may be formed using the securing elements 21 and the further securing elements 33. First, the securing elements 21 are lifted until the harness holders 28 are above the groove 37 of the rests 35. Thereupon the strip 38 is inserted into the groove 37 so that the tines 39 are located underneath the holders 28 of every second harness 5. Next, the securing elements 21 are moved downward again. In the process, by means of their holders 28, some of the harnesses 5 rest on the tines 39 of the strip 38, and the remaining harnesses 5 by means of their holders remain on the securing elements 21 which lower them. Following insertion of a tensioning rod or the like, the securing elements 21 can be raised again until all holders 28 are once more carried along and are located above the groove 37. Thereupon the strip 38 can be displaced in such a way that the tines 39 are located underneath the holders 28 of the previously lowered harnesses. When the securing elements 21 are lowered again, they again form two sets of warps and a further tensioning rod or the like can be inserted between the two sets. Installing a tensioning rod is often required in order to automatically tie warps to the warps from a new warp beam.

Figure 9:
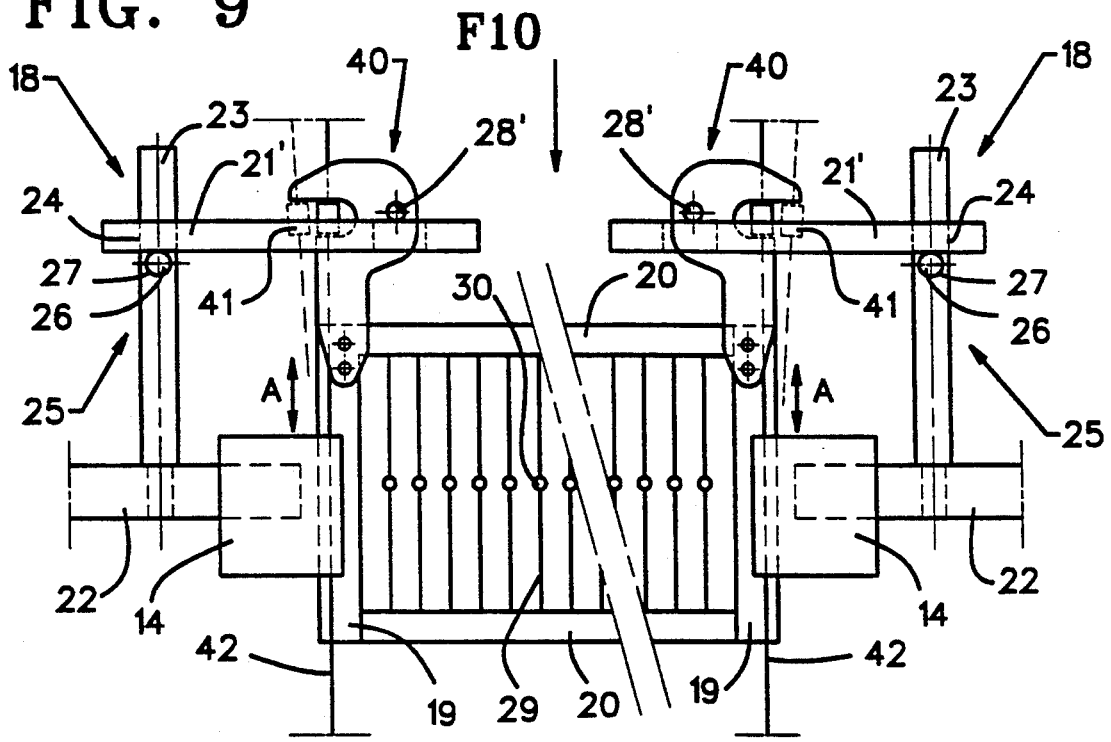
FIG. 9 is a partial view of another preferred embodiment of the invention.
Figure 10:
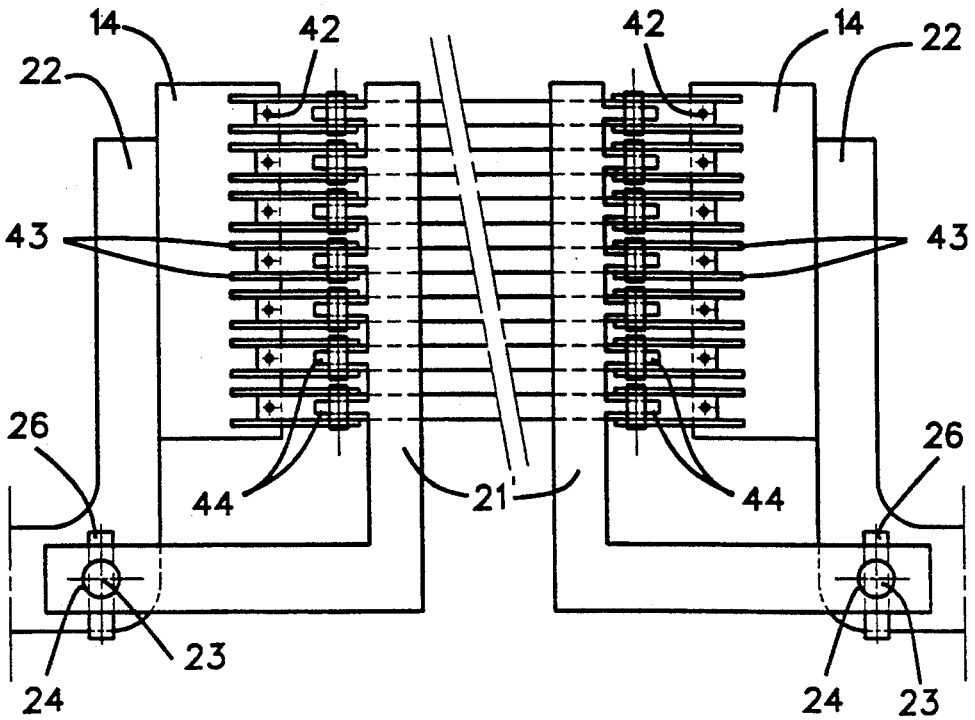
FIG. 10 is a top view in the direction of the arrow F10 of FIG. 9.

As regards the embodiment of FIGS. 9 and 10, the harnesses 5 are driven by cables 42 each fitted with a coupling element 41 engaged by a hooked coupling element 40 affixed to and projecting above and beyond the lateral shaped-sections 19 of the frames of the harnesses 5. The coupling elements 40 each consist of two lateral plates 43. In each instance a bolt acting as the securing element 28' is mounted between the two lateral plates 43 and cooperates with the securing means 18. Essentially the securing means 18 correspond to those of the embodiment of FIGS. 1 through 4. The securing elements 21' also are L-shaped, with first comb-like legs pointing in the direction of advance of the fabric, and one tine 44 of each of the combs extending into the area of the holders 28'. In a modification of this embodiment, the tines 44 are hook-shaped. Because these tines 44 enter between the plates 43 of the hook-shaped coupling elements 40, they keep the harnesses 5 mutually spaced at a defined distance.

When separating the removable loom part, the securing means 18 are mounted on the arms 22 of the side parts of the loom frame in such a manner that the tines 44 receive the holders 28'. Previously, the coupling elements 41 were pivoted to the side to assume the dashed position shown in FIG. 9. In order to be able to disassemble the loom, the harness guides 14 are moved back sideways in a known manner until they release the cables 42. Thereafter, the removable loom part 3 can be separated from the stationary loom part 2.

In a further variation of the embodiment of FIGS. 9 and 10, the harness guides 14 are mounted on the stationary loom part 2 (FIGS. 1 and 2). In this case, the harnesses alone are carried along with the removable loom part. This is easily accomplished in the embodiment of FIGS. 9 and 10 because the tines 44 of the strips 21' hold the individual harnesses 5 in such a way that their spacing is preserved.

Finally, it is noted that in addition to these specifically described variations and modifications of the preferred embodiments other modifications which will undoubtedly occur to those skilled in the art and are also intended to be included within the scope of the invention. Consequently, the above description and illustrations should not be taken as limiting in any way, the invention being defined solely by the appended claims.

We claim:

1. A split loom comprising:

harnesses;

a stationary loom part containing a harness drive;

a removable loom part containing a warp-beam bearing and means for detachably connecting the harnesses to the harness drive;

holding elements mounted on the harnesses; and securing elements for supporting said holding elements in order to hold said harnesses at predetermined positions relative to the removable loom part.

2. A loom as claimed in claim 1, further comprising heddles positioned on the harness, wherein the holding elements are mounted on the harnesses outside an area at which the heddles are positioned.

3. A loom as claimed in claim 1, wherein said securing means comprises securing elements, and further comprising means for adjusting a position of the securing elements with respect to the means for detachably connecting the harnesses to the harness drive.

4. A loom as claimed in claim 3, wherein said securing elements are L-shaped, one leg of the L-shape forming means extending in a direction of advance of a fabric for engaging the holding elements, and means for affixing the securing elements to a side part of the removable loom part.

5. A loom as claimed in claim 1, wherein the holding elements include means for keeping the harnesses at a predetermined distance from one another when the removable loom part is removed from the stationary loom part.

6. A split loom comprising:

harnesses;

a stationary loom part containing a harness drive;

a removable loom part containing a warp-beam bearing and means for detachably connecting the harnesses to the harness drive;

holding elements mounted on the harnesses; and securing means for supporting said holding elements in order to hold said harnesses at predetermined positions relative to the removable loom part.

wherein said securing means comprise L-shaped securing elements, one leg of each of the L-shaped securing elements forming means extending in a direction of advance of a fabric for engaging a respective one of the holding elements, and further comprising means for affixing the securing elements to a side part of the removable loom part, and means for adjusting a position of the securing elements with respect to the means for detachably connecting the harnesses to the harness drive, wherein said means for affixing the securing elements comprises means including at least one rest for guiding the securing elements so as to be affixable in at least one predetermined positions.

7. A split loom comprising:

harnesses;

a stationary loom part containing a harness drive;

a removable loom part containing a warp-beam bearing and means for detachably connecting the harnesses to the harness drive;

holding elements mounted on the harnesses;

securing means for supporting said holding elements in order to hold said harnesses at predetermined positions relative to the removable loom part; and means including harness guides mounted on the removable loom part.

8. A split loom comprising:

harnesses;

a stationary loom part containing a harness drive;

a removable loom part containing a warp-beam bearing and means for detachably connecting the harnesses to the harness drive;

holding elements mounted on the harnesses; and securing means for supporting said holding elements in order to hold said harnesses at predetermined positions relative to the removable loom part, wherein the securing means include means for keeping the harnesses at a predetermined distance from one another.

9. A split loom comprising:

harness;

a stationary loom part containing a harness drive;

a removable loom part containing a warp-beam bearing and means for detachably connecting the harnesses to the harness drive;

holding elements mounted on the harnesses; and securing means for supporting said holding elements in order to hold said harnesses at predetermined positions relative to the removable loom part, wherein said securing means comprise at least two different securing elements, each of which forms means for securing a plurality of harnesses, and means for adjusting at least one of the securing elements to different positions.

10. A loom as claimed in claim 9, wherein one of said securing elements is a strip having clearances to form a comb shape, the tines of the comb shape forming means for engaging a predetermined set of harnesses, and further comprising means for affixing said strip at a predetermined height on the removable loom part.

* * * * *